US011083932B2

(12) United States Patent
Hilburn, III

(10) Patent No.: US 11,083,932 B2
(45) Date of Patent: Aug. 10, 2021

(54) AUTOMATIC SALMON LADDER TRAINING DEVICE

(71) Applicant: Eddie Lee Hilburn, III, Albuquerque, NM (US)

(72) Inventor: Eddie Lee Hilburn, III, Albuquerque, NM (US)

( * ) Notice: Subject to any disclaimer, the term of this patent is extended or adjusted under 35 U.S.C. 154(b) by 0 days.

(21) Appl. No.: 16/696,612

(22) Filed: Nov. 26, 2019

(65) Prior Publication Data

US 2020/0171350 A1 Jun. 4, 2020

Related U.S. Application Data

(60) Provisional application No. 62/774,311, filed on Dec. 2, 2018.

(51) Int. Cl.

| | |
|---|---|
| ***A63B 22/04*** | (2006.01) |
| ***A63B 23/12*** | (2006.01) |
| ***A63B 21/005*** | (2006.01) |
| ***A63B 21/012*** | (2006.01) |
| ***A63B 22/00*** | (2006.01) |

(52) U.S. Cl.

CPC ..... *A63B 23/1218* (2013.01); *A63B 21/005* (2013.01); *A63B 21/012* (2013.01); *A63B 22/0005* (2015.10); *A63B 22/04* (2013.01); *A63B 2022/0035* (2013.01)

(58) Field of Classification Search

CPC . A63B 22/0005; A63B 22/04; A63B 22/0002; A63B 22/0025; A63B 23/1218; A63B 23/03525; A63B 23/0216; A63B 21/012; A63B 21/0004; A63B 21/005–0052; A63B 2022/035; A63B 2022/0092; A63B 2009/00; A63B 2009/006; A63B 17/00; A63B 17/04

See application file for complete search history.

(56) References Cited

U.S. PATENT DOCUMENTS 2,042,764 A * 6/1936 Birch ..... A63B 22/001 482/52
4,822,029 A * 4/1989 Sarno ..... A63B 22/0002 482/120

(Continued)

OTHER PUBLICATIONS

Fixfast USA, "Fixed Ladder Compliance Checklist," uploaded Jun. 2016, 3 pages, retrieved from the Internet: http://www.fixfastusa.com/wp-content/uploads/2016/06/OSHA-1910.27-Compliance-Checklist.pdf (Year: 2016).*

*Primary Examiner* — Megan Anderson
*Assistant Examiner* — Kathleen Vermillera
(74) *Attorney, Agent, or Firm* — Patent Portfolio Builders PLLC

(57) ABSTRACT

Automatic salmon ladder training devices are provided. An automatic salmon ladder training device may include a frame and a rotation assembly. The rotation assembly may include a plurality of rotation subassemblies. The plurality of rotation subassemblies may each include a chain rotatably engaged by the rotation subassembly, a rung fixedly connected to the chain, and a fixed rung fixedly connected to the frame. Each of the rotation subassemblies are configured to rotate in concert with one another. For example, a left rotation subassembly and a right rotation subassembly may be configured to rotate in concert with one another.

20 Claims, 5 Drawing Sheets

(56) References Cited

U.S. PATENT DOCUMENTS

| | | | | | |
|---|---|---|---|---|---|
| 4,848,737 | A * | 7/1989 | Ehrenfield | A63B 21/157 | 482/52 |
| 4,923,191 | A * | 5/1990 | Persico | A63B 22/001 | 482/52 |
| 5,112,043 | A * | 5/1992 | Gilfillian, Jr. | A63B 22/001 | 482/37 |
| 5,145,472 | A * | 9/1992 | Johnson, III | A63B 23/12 | 482/119 |
| 5,145,475 | A * | 9/1992 | Cares | A63B 21/157 | 482/52 |
| 5,328,422 | A * | 7/1994 | Nichols | A63B 22/001 | 482/111 |
| 9,017,224 | B1 * | 4/2015 | Singley | A63B 22/0023 | 482/52 |
| 9,440,132 | B2 * | 9/2016 | Brewer | A63B 69/0048 | |
| 2007/0042876 | A1 * | 2/2007 | Lundquist | A63B 21/0783 | 482/94 |
| 2014/0087928 | A1 * | 3/2014 | Luedeka | A63B 21/0552 | 482/130 |
| 2017/0252594 | A1 * | 9/2017 | McKenna | A63B 3/00 | |

* cited by examiner

AUTOMATIC SALMON LADDER TRAINING DEVICE

TECHNICAL FIELD

The present invention generally relates to equipment for fitness training. More particularly, the present invention relates to a device for use in training for dynamic pull-up type exercises.

BACKGROUND

Obstacle course training and competitions continue to gain popularity worldwide, not only as a means of competition, but also as an enjoyable, variable, and engaging form of exercise. As popularity increases, so too does the demand for training facilities. The construction of obstacles used in such training facilities varies widely from self-made to retail purchased, with materials ranging from construction grade lumber to commercial grade steel. To some degree this variation is considered part of the obstacle course training experience, as similar obstacles in different training facilities can present slight differences in completion tactics.

One of the more popular versions of obstacle course competitions are Ninja Warrior style events, modeled after popular television shows such as American Ninja Warrior and Sasuke. In these events, there is wide-ranging variation in the types of obstacles an athlete might encounter, but there are also a few staples that are very nearly universal in the sport. Examples of these staple obstacles include the Warped Wall and the Salmon Ladder. As competition in obstacle course competitions reaches a more elite level, and athletes begin to train with more rigor, the time-tested training methodology of repeatability and progressive overload will become more important to their success.

FIG. 1 is a left perspective view of a typical salmon ladder device 100. A typical salmon ladder device 100 includes a frame including left and right support members 102, 104. The left and right support members 102, 104 each include a fixed number of corresponding rungs 106*a-n* determined by a height of the training facility and/or a subjectively determined safe fall height.

In view of the problems discussed herein, there is a need to provide devices that overcome drawbacks associated with existing devices for use in training for dynamic pull-up type exercises.

SUMMARY

Embodiments provide for automatic salmon ladder training devices which enable an athlete to perform continuous salmon ladder training exercises while remaining in place. These embodiments can be advantageous by reducing overall device height and improving safety and training effectiveness for an athlete.

According to an embodiment, there is an automatic salmon ladder training device. The automatic salmon ladder training device may include a left frame assembly and a right frame assembly, each including an upper support, a rear upright support, a lower support, and a front upright channel support. The automatic salmon ladder training device may further include a left rotation subassembly, including a left upper sprocket mounted to the upper support of the left frame assembly, a left lower sprocket mounted to the lower support of the left frame assembly, a left chain rotatably engaged by the left upper sprocket and the left lower sprocket, and a plurality of left rungs fixedly connected to the left chain. The automatic salmon ladder training device may further include a right rotation subassembly, including a right upper sprocket mounted to the upper support of the right frame assembly, a right lower sprocket mounted to the lower support of the right frame assembly, a right chain rotatably engaged by the right upper sprocket and the right lower sprocket, and a plurality of right rungs fixedly connected to the right chain. The left rotation subassembly and the right rotation subassembly may be rotatably connected by a shaft.

According to another embodiment, there is an automatic salmon ladder training device. The automatic salmon ladder training device may include a frame and a rotation assembly. The rotation assembly may include a plurality of rotation subassemblies. The plurality of rotation subassemblies may each include a chain rotatably engaged by the rotation subassembly, a rung fixedly connected to the chain, and a fixed rung fixedly connected to the frame. Each of the rotation subassemblies are configured to rotate in concert with one another.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

In the following description, for purposes of explanation and non-limitation, specific details are set forth in order to provide an understanding of the described embodiments. It will be apparent to one skilled in the art that other embodiments may be practiced apart from the specific details disclosed below. In other instances, detailed descriptions of well-known methods, devices, techniques, etc. are omitted so as not to obscure the description with unnecessary detail.

As described in the Background section, a typical salmon ladder device 100 may include a frame including left and right support members 102, 104 that may each include a fixed number of corresponding rungs 106*a-n* determined by a height of a training facility and/or a subjectively determined safe fall height. Such a fixed obstacle height artificially limits the ability to practice the obstacle with uninterrupted repeatability, and limits the opportunity to progressively overload by, for example, increasing repetitions of the exercise as the participant gains strength and technique.

Regardless of facility height constraints and/or safety determination, many people are reluctant to attempt a typical salmon ladder device 100 due to a fear of heights, since the natural movement of a salmon ladder exercise is ever-upward.

Embodiments described herein provide for automatic salmon ladder training devices, which are also referred to herein as automatic salmon ladders. Embodiments enable an athlete to perform continuous salmon ladder training exercises while remaining in place, that is, while the athlete remains in the same general physical location. By incorporating an automatic salmon ladder training device into a training environment, drawbacks such as facility height and safe fall distance limitations can be mitigated. Training can be accomplished despite certain physical limitations of the athlete, unconstrained by the limited rungs in a fixed environment. For newer athletes or enthusiasts who may be uncomfortable with the idea of additional height, the height of the automatic salmon ladder itself may be fixed at a starting position. Falling from the starting position may be much safer than, for example, falling after completing several movements on a typical fixed-rung salmon ladder.

Figure 1:
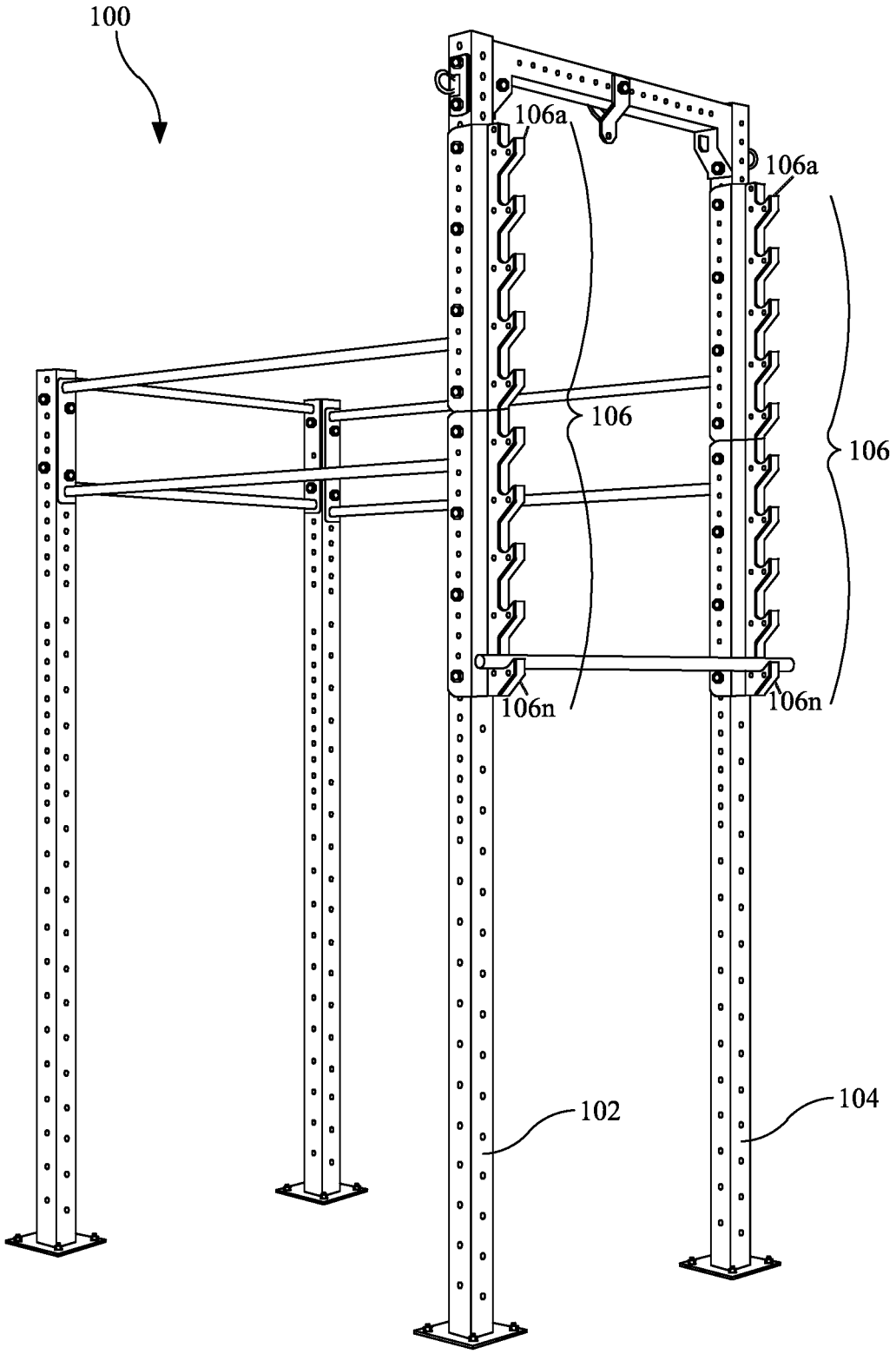
FIG. 1 (Background Art)
FIG. 1 is a left perspective view of a typical salmon ladder device.
Figure 2:
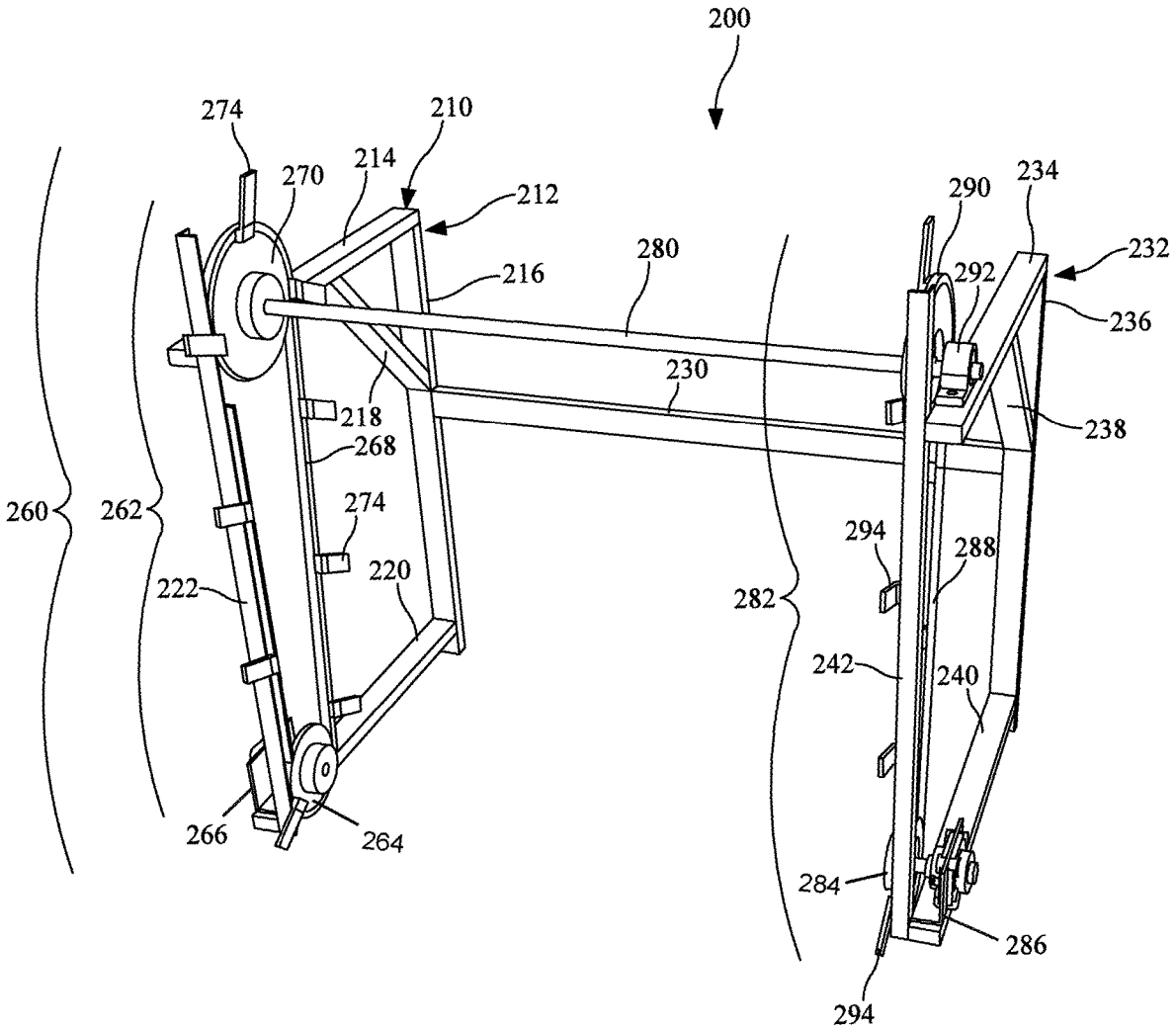
FIG. 2 is a front perspective view of an automatic salmon ladder training device according to an embodiment of the present invention.
Figure 3:
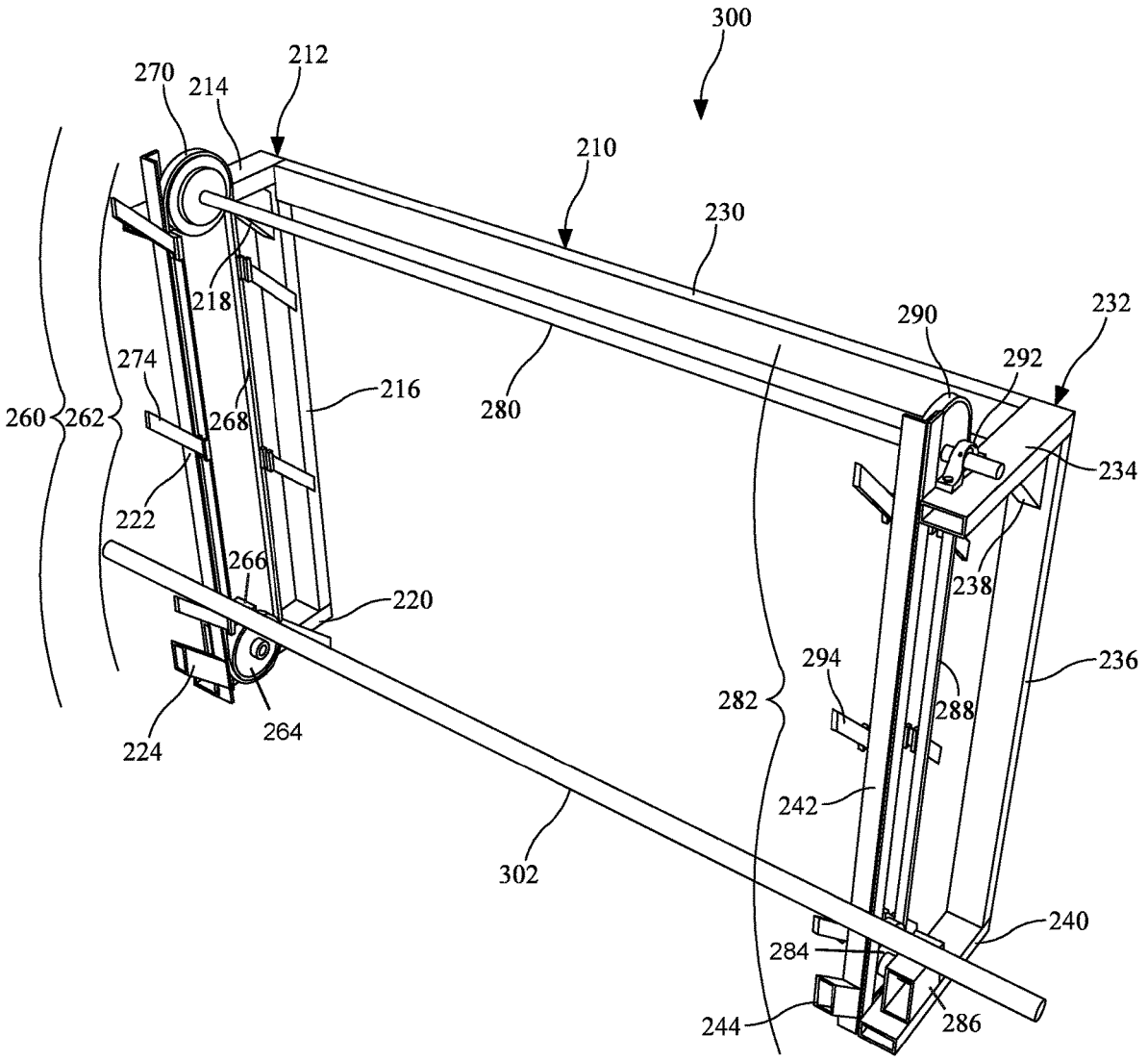
FIG. 3 is a front perspective view of an automatic salmon ladder training device according to another embodiment of the present invention.
Figure 4A:
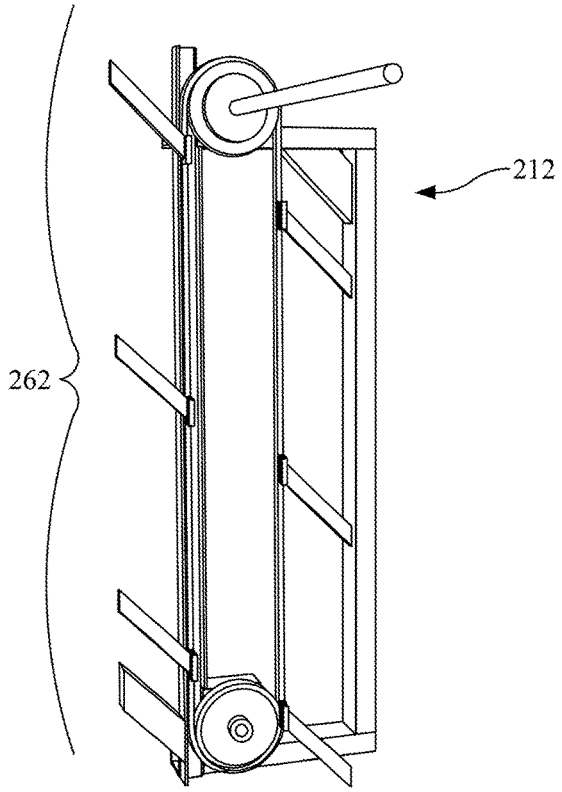
FIG. 4A is a perspective view of an inner side of a left frame assembly and a left rotation subassembly of the embodiment of FIG. 3.
Figure 4B:
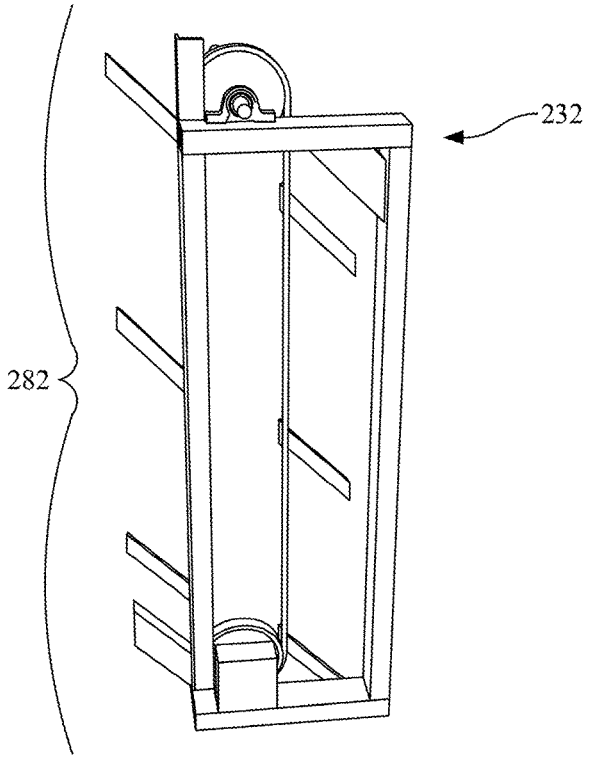
FIG. 4B is a perspective view of an outer side of a right frame assembly and a right rotation subassembly of FIG. 3.

FIG. 2 is a front perspective view of an automatic salmon ladder training device 200 according to an embodiment of the present invention. FIG. 3 is a front perspective view of an automatic salmon ladder training device 300 according to another embodiment of the present invention. FIG. 4A is a perspective view of an inner side of the left frame assembly 212 and the left rotation subassembly 262 of the embodiment of FIG. 3. FIG. 4B is a perspective view of an outer side of the right frame assembly 232 and the right rotation subassembly 282 of FIG. 3. The automatic salmon ladder 200, 300 may include a frame 210 and rotation assembly 260. The frame 210 may support the rotation assembly 260.

The frame 210 may include a left frame assembly 212 and a right frame assembly 232 connected by a frame connector crossbar 230. The left frame assembly 212 and the right frame assembly 232 may mirror each other and may include one or more identical and/or mirrored features. The rotation assembly 260 may include a left rotation subassembly 262 and a right rotation subassembly 282 connected by shaft 280. The left rotation subassembly 262 and the right rotation subassembly 282 may mirror each other and may include one or more identical and/or mirrored features.

The left and right frame assemblies 212, 232 may each include an upper support 214, 234, a rear upright support 216, 236, a gusset support 218, 238, a lower support 220, 240, and a front upright channel support 222, 242. Upper supports 214, 234, rear upright supports 216, 236, gusset supports 218, 238, lower supports 220, 240, and front upright channel supports 222, 242 may be formed of metal such as steel or aluminum, as may additional features such as fixed rungs 224, 244 (discussed with FIG. 3) and the shaft 280. Additional and/or alternative materials may include carbon fiber, wood, or composites. Upper supports 214, 234, rear upright supports 216, 236, gusset supports 218, 238, lower supports 220, 240, and front upright channel supports 222, 242 may be connected to each other as shown in FIG. 2 and/or FIG. 3, e.g., by welds, nut and/or bolt, or other fasteners.

The upper supports 214, 234 may support (e.g., serve as a mount) shaft 280 and upper sprockets 270, 290. For example, each upper support 214, 234 may include an upper sprocket mount 272, 292 (e.g., a pillow block bearing) attached to a top surface of the upper support 214, 234. The upper supports 214, 234 and the upper sprocket mounts 272, 292 may rotatably support shaft 280. In an alternative embodiment, each upper support 214, 234 may include a hole as the upper sprocket mount 272, 292, partially or completely through the upper support 214, 234, to rotatably support shaft 280. In another alternative embodiment, each upper support 214, 234 may include a bend (e.g., on an upper surface) as the upper sprocket mount 272, 292 to rotatably support shaft 280. Throughout this disclosure, features from one embodiment may be combined with features from another. Accordingly, in yet another alternative embodiment, one of the upper supports 214, 234 may include, e.g., a pillow block, while another may include, e.g., a hole.

The rear upright supports 216, 236 may provide structural support to the automatic salmon ladder 200, 300. The rear upright supports 216, 236 may connect to the upper supports 214, 234. The rear upright supports 216, 236 may be configured to mount the automatic salmon ladder 200, 300 to an external structure. That is, the rear upright supports 216, 236 may serve as a mounting interface to mount the automatic salmon ladder 200, 300 to various structures, such as a wall or external rack. For example, each of the rear upright supports 216, 236 may include bolt holes. In another embodiment, each of the rear upright supports 216, 236 may include integrated fasteners. In yet another embodiment, the automatic salmon ladder 200, 300 may be freestanding and the rear upright supports 216, 236 may provide structural support may not be mounted to another structure.

The gusset supports 218, 238 may provide additional structural support to the automatic salmon ladder 200, 300. For example, the gusset supports 218, 238 may provide structural support to, e.g., the connection of the rear upright supports 216, 236 to the upper supports 214, 234. The gusset supports 218, 238 may be angled as shown in FIG. 2 and may connect to the upper supports 214, 234 and the rear upright supports 216, 236. In another embodiment, the gusset supports 218, 238 may take the form of a gusset plate.

The lower supports 220, 240 may support (e.g., mount) one or more lower sprockets 264, 284. For example, each lower support 220, 240 may include a sprocket mount 266, 286 attached to a top surface of the lower support 220, 240. In an alternative embodiment, each lower support 220, 240 may include a hole, partially or completely through the lower support 220, 240 to rotatably support shaft 280. In another alternative embodiment, each lower support 220, 240 may include a bend (e.g., on a lower surface) to rotatably support shaft 280. The lower supports 220, 240 may connect to the rear upright supports 216, 236.

The front upright channel supports 222, 242 may guide a chain 268, 288 of the rotation assembly 260. That is, the front upright channel supports 222, 242 may serve as a conduit through which chain 268, 288 may pass without being impacted by bar 302 (FIG. 3) during operation of the automatic salmon ladder 200, 300. The front upright channel supports 222, 242 may each be open on a side closest to a respective rear upright support 216, 236, and may also each be open on a side closest to the other respective front upright channel support 222, 242 so that the chain 268, 288 and attached rungs 274, 294 are able to rotate. That is, each of the front upright channel supports 222, 242 may be open on a rear side and on an inner side. The front upright supports 222, 242 may connect to the lower supports 220, 240 and may connect to the upper supports 214, 234.

The automatic salmon ladder 300 of FIG. 3 includes a fixed rung 224, 244 protruding from a front surface of each of the front upright channel supports 222, 242. The fixed rung 224, 244 may serve as a starting location for the bar 302 during exercise. The fixed rung 224, 244 may serve as a resting location for the bar 302 in between movements.

The dimensions of the frame 210 may vary from embodiment to embodiment. The length of the chains 268, 288 may affect the dimensions of the frame 210. In the embodiment of FIG. 3, the rungs 274, 294 of the automatic salmon ladder 300 may be spaced twelve (12) inches apart from one another. In such an embodiment, when there are a total of six (6) rungs 274, 294 as part of each of the left and right rotation subassemblies 262, 282, an overall height of the frame 210 may be approximately thirty-four (34) inches. In another embodiment, the length of the chains 268, 288 may be different, as may be the number of rungs 274, 294 included thereby leading to different dimensions. The width of the frame 210 of the embodiment 300 of FIG. 3 may be approximately forty-eight (48) inches, and the depth of the frame 210 (e.g., the length of the upper supports 214, 234 and the lower supports 220, 240) may be approximately ten (10) inches.

Dimensions, as noted above, may vary, and may also be dependent upon the structure to which the automatic salmon ladder 200, 300 is to be attached to. For example, the length of the upper supports 214, 234 and lower supports 220, 240 of the left and right frame assemblies may be between eight (8) and thirty-eight (38) inches. The automatic salmon ladder 300 of FIG. 3 may be configured to be mounted or attached to a freestanding structure such as an external frame which may have no impediment to the sagittal movement of an athlete performing an exercise. The automatic salmon ladder 200 of FIG. 2 may be configured to be mounted or attached to a wall. Accordingly, the depth of the frame 210 may be approximately thirty (30) to thirty-six (36) inches to accommodate for the movement of the athlete performing the exercise so as to prevent the legs or feet of the athlete from impacting the wall during the exercise.

Turning to the rotation assembly 260, the left and right rotation subassemblies 262, 282 may be connected by the shaft 280. The left and right rotation subassemblies 262, 282 may each include an upper sprocket 270, 290, a lower sprocket 264, 284, and a chain 268, 288 engaged by the upper sprocket 270, 290 and the lower sprocket 264, 284. As shown in FIG. 3, each chain 268, 288 may include rungs 274, 294, at least some of which protruding forward relative to the front surface of each of the front upright channel supports 222, 242. Further as shown in FIG. 3, at lease some of the rungs 274, 294, may protrude parallel to at least one of the above-discussed fixed rungs 224, 244. Further as shown in FIG. 3, a left one of the rungs 274 may not directly contact the right chain 288, and a right one of the rungs 294 may not directly contact the left chain 268.

The upper sprockets 270, 290 may engage chains 268, 288. The upper sprockets 270, 290 may each be fixedly attached to or otherwise locked with the shaft 280 such that upper sprockets 270, 290 and therefore the left and right rotation subassemblies rotate in concert with one another rather than independently. This fixed attachment to the shaft 280 of the upper sprockets 270, 290 may enable corresponding rungs 274, 294 to remain in alignment with one another during use of the salmon ladder 200, 300. The lower sprockets 264, 284 may engage chains 268, 288.

As earlier noted, each upper support 214, 234 of the frame assemblies 212, 232 may include an upper sprocket mount 272, 292 that may rotatably support shaft 280. The upper sprocket mounts 272, 292 may each include a support shaft bearing and/or bushing enabling rotation of the shaft 280. The upper sprocket mounts 272, 292 (e.g., including bearings or bushings) may be fixedly attached to the upper supports 214, 234 such that the shaft 280 is unable to shift laterally. The positioning of the upper sprocket mounts 272, 292 along the upper supports 214, 234 may maintain alignment of the shaft 280, the upper sprockets 270, 290, and the chains 268, 288 relative to the front upright channel supports 220, 240.

Figure 5A:
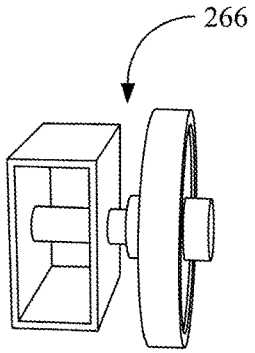
FIG. 5A is a perspective view of a lower sprocket mount of a frame assembly according to an embodiment of the present invention.
Figure 5B:
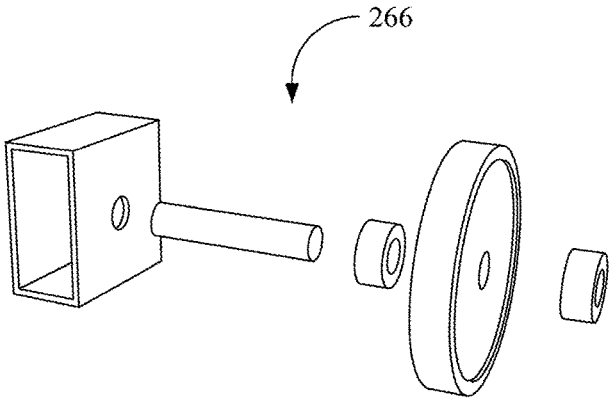
FIG. 5B is an exploded view of the lower sprocket mount of FIG. 5A.

Each lower support 220, 240 may include a lower sprocket mount 266, 286. FIG. 5A is a perspective view of lower sprocket mount 266 of the left frame assembly 212. FIG. 5B is an exploded view of the lower sprocket mount 266. The lower sprocket mount 286 of the right frame assembly 232 may be identical with and/or mirror lower sprocket mount 266. The lower sprocket mount 266 may include a housing receiving a mount shaft and the lower sprocket 264 along with a bearing and/or bushing. The positioning of the lower sprocket mounts 266, 286 along the lower supports 220, 240 may maintain alignment of the lower sprockets 264, 284 and the chains 268, 288 relative to the front upright channel supports 220, 240.

The chains 268, 288 may be engaged by and rotate about the upper sprockets 270, 290 and the lower sprockets 264, 284. That is, the lower sprockets 264, 284 and the upper sprockets 270, 290 may serve as the mechanical interface with the chains 268, 288. The lower sprockets 264, 284 and the upper sprockets 270, 290 may maintain alignment of the chains 268, 288 with the front upright channel supports 222, 242. The lower sprockets 264, 284 and the upper sprockets 270, 290 may allow the chains 268, 288 to rotate freely and/or subject to a braking mechanism. That is, some embodiments may include a braking mechanism to control the rotation speed of one or more of the components of one or both of the rotation subassemblies 262, 282 so as to control the rotation speed of the chains 268, 288. In an embodiment, one or more brake pad or sets of brake pads may be provided with, e.g., a disk attached to the shaft. In another embodiment, an electronic induction brake may be provided to enable adjustability of an amount of braking.

Figure 6A:
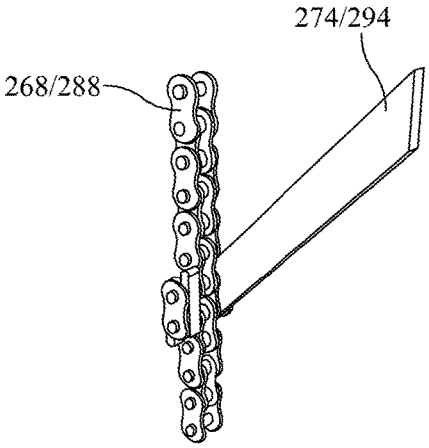
FIG. 6A is perspective view of a portion of a chain and a rung according to an embodiment of the present invention.
Figure 6B:
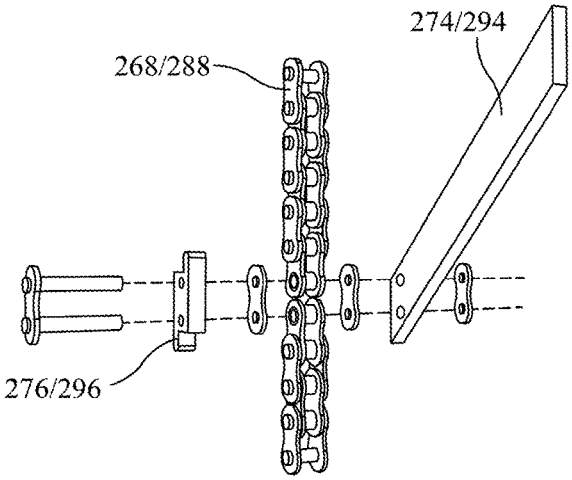
FIG. 6B is an exploded view of the portion of the chain and the rung of FIG. 6A.

FIG. 6A is perspective view of a portion of a chain 268, 288 and a rung 274, 294. FIG. 6B is an exploded view of the portion of the chain 268, 288 and the rung 274, 294. The rung 274, 294 may be connected to the chain (may be integrated with the chain) using a rung channel guide 276/296, links with longer pins, and plates. For example, when an ANSI 40 roller chain is used for the chains 268, 288, a standard ANSI 40-1 connecting link may be replaced with an ANSI 40-2 connecting link at regular 12 inch intervals. The pins of an ANSI 40-2 connecting link may be double the length of pins of a standard ANSI 40-1 connecting link. The rung 274, 294 may include holes for receiving the pins. The rung channel guide 276/296 may serve as a spacer. The rung channel guide 276/296 may (e.g., with extended tips) prevent rungs 274, 294 from over-rotating when engaged by locking into the channel. Dimensions of the chains 268/288 and other components of the automatic salmon ladder 200, 300 may be varied.

An athlete may use the automatic salmon ladder 300 of FIG. 3 by grabbing the bar 302 which may be resting on fixed rungs 224, 244. The athlete may perform a dynamic pullup and, at the apex of the movement, reposition the bar 302 onto the next higher set of rungs 274, 294. Once the bar 302 is resting on said set of rungs 274, 294, the weight of the athlete will initiate rotation of the chains 268, 288 lowering the athlete and the bar 302 ultimately to the fixed rungs 224, 244. The exercise repetition may be complete when the bar 302 is resting on the fixed rungs 224, 244. The athlete may repeat as many exercise repetitions as desired in a continuous manner.

In considering the embodiments discussed herein, when an element is referred to as being "connected", "coupled", "responsive", "attached", "mounted", or variants thereof to another element, it can be directly connected, coupled, attached, mounted, or responsive to the other element or intervening elements may be present. In contrast, when an element is referred to as being "directly connected", "directly coupled", "directly responsive", "directly attached", "directly mounted", or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items. The terms "left", "right", "front", "rear", and the like may be used herein to describe various elements but these elements should not be limited by these terms. Rather, these terms are used to distinguish one element from another element or for the convenience of description and explanation thereof, and could be, e.g., reversed.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of various exemplary combinations and subcombinations of embodiments and of the manner and process of making and using them, and shall support claims to any such combination or subcombination.

Many variations and modifications can be made to the embodiments without substantially departing from the principles of the present solution. All such variations and modifications are intended to be included herein within the scope of the present solution.

What is claimed is:

1. An automatic salmon ladder training device, comprising:
- a frame; and
- a rotation assembly, including:
  - a plurality of rotation subassemblies, each including:
    - a chain rotatably engaged by the respective rotation subassembly;
    - a rung fixedly connected to the chain, the rung protruding forward from the chain relative to a front surface of the frame, wherein the rung is configured to receive and support a bar; and
    - a fixed rung fixedly connected to the frame, wherein the rung and the fixed rung protrude parallel to each other;

wherein each of the plurality of rotation subassemblies are configured to rotate in concert with one another.

2. The automatic salmon ladder training device of claim 1, wherein in each of the plurality of rotation subassemblies, the rung fixedly connected to the chain is one among a plurality of rungs fixedly connected to the chain.

3. The automatic salmon ladder training device of claim 2, wherein the plurality of rungs fixedly connected to the chain of each of the plurality of rotation subassemblies are spaced twelve inches apart from one another.

4. The automatic salmon ladder training device of claim 1, wherein the plurality of rotation subassemblies includes at least one sprocket mounted to the frame, wherein the chain of each of the plurality of rotation subassemblies is engaged by the respective at least one sprocket.

5. The automatic salmon ladder training device of claim 1, further comprising a shaft connecting the plurality of rotation subassemblies.

6. The automatic salmon ladder training device of claim 1, wherein the frame is configured to connect the automatic salmon ladder training device to a separate structure.

7. The automatic salmon ladder training device of claim 1, wherein the rung of each of the plurality of rotation subassemblies is connected to the respective chain of each of the plurality of rotation subassemblies by a link and a rung channel guide, wherein the link include pins.

8. The automatic salmon ladder training device of claim 1, further comprising a brake configured to slow rotation of the plurality of rotation subassemblies.

9. An automatic salmon ladder training device, comprising:
- a left frame assembly and a right frame assembly, each including an upper support, a rear upright support, a lower support, and a front upright channel support;
- a left rotation subassembly, including:
  - a left upper sprocket mounted to the upper support of the left frame assembly;
  - a left lower sprocket mounted to the lower support of the left frame assembly;
  - a left chain rotatably engaged by the left upper sprocket and the left lower sprocket; and
  - a plurality of left rungs fixedly connected to the left chain, wherein at least one of the plurality of left rungs protrudes forward from the left chain relative to a front surface of the front upright channel support of the left frame assembly; and
- a right rotation subassembly, including;
  - a right upper sprocket mounted to the upper support of the right frame assembly;
  - a right lower sprocket mounted to the lower support of the right frame assembly;
  - a right chain rotatably engaged by the right upper sprocket and the right lower sprocket; and
  - a plurality of right rungs fixedly connected to the right chain, wherein at least one of the plurality of right rungs protrudes forward from the right chain relative to a front surface of the front upright channel support of the right frame assembly;

wherein the left rotation subassembly and the right rotation subassembly are rotatably connected by a shaft, wherein the left and right chains pass through the respective front upright channel support of the left and right frame assemblies during rotation of the left and right chains, and wherein the at least one of the plurality of left rungs and the at least one of the plurality of right rings are configured to receive and support a bar.

10. The automatic salmon ladder training device of claim 9, wherein the left frame assembly further comprises a left upper sprocket mount and the right frame assembly further comprises a right upper sprocket mount, wherein the left and right upper sprocket mounts are configured to receive the shaft.

11. The automatic salmon ladder training device of claim 9, wherein the rear upright supports of each of the left and right frame assemblies are configured to connect the automatic salmon ladder training device to a separate structure.

12. The automatic salmon ladder training device of claim 9, wherein each of of the left and right frame assemblies further comprise a gusset support extending between the respective upper support and the respective rear upright support.

13. The automatic salmon ladder training device of claim 9, wherein the upper support, rear upright support, lower support, and front upright channel support of each of the left and right frame assemblies are connected by welds.

14. The automatic salmon ladder training device of claim 9, wherein the plurality of left rungs are spaced twelve inches apart from one another along the left chain, and wherein the plurality of right rungs are spaced twelve inches apart from one another along the right chain.

15. The automatic salmon ladder training device of claim 9, wherein the left upper sprocket and the right upper sprocket are each fixedly attached to the shaft such that left and right rotation subassemblies rotate in concert with one another.

16. The automatic salmon ladder training device of claim 9, wherein the plurality of left rungs and the plurality of right rungs are respectively connected to the left and right chains by links and rung channel guides, wherein the links include pins.

17. The automatic salmon ladder training device of claim 9, wherein a length of the upper supports and lower supports of the left and right frame assemblies is between 8 and 38 inches.

18. The automatic salmon ladder training device of claim 9, further comprising at least one brake configured to slow rotation of the left and right rotation subassemblies.

19. The automatic salmon ladder training device of claim 9, further comprising:

a left fixed rung protruding from the front surface of the front upright channel support of the left frame assembly, and a right fixed rung protruding from the front surface of the front upright channel support of the right frame assembly, wherein the left fixed rung and the at least one the plurality of left rungs protrude parallel to each other, and the right fixed rung and the at least one of the plurality of right rungs protrude parallel to each other.

20. The automatic salmon ladder training device of claim 9, wherein the at least one of the plurality of left rungs does not directly contact the right chain, and the at least one of the plurality of right rungs does not directly contact the left chain.

* * * * *